United States Patent [19]

Trachte et al.

[11] Patent Number: 4,747,545

[45] Date of Patent: May 31, 1988

[54] FUEL INJECTION NOZZLE FOR INTERNAL COMBUSTION ENGINES

[75] Inventors: Dietrich Trachte, Kornwestheim; Helmut Giess, Aspach, both of Fed. Rep. of Germany

[73] Assignee: Robert Bosch GmbH, Stuttgart, Fed. Rep. of Germany

[21] Appl. No.: 429,955

[22] Filed: Sep. 30, 1982

[30] Foreign Application Priority Data

Jun. 7, 1982 [DE] Fed. Rep. of Germany ..... 3221442

[51] Int. Cl.[4] ..... F02M 61/20

[52] U.S. Cl. ..... 239/533.9; 239/453; 251/50

[58] Field of Search ..... 239/533.2–533.12; 251/50

[56] References Cited

U.S. PATENT DOCUMENTS 2,621,015 12/1952 MacGregor ..... 251/50
2,621,016 12/1952 MacGregor ..... 251/50
4,417,693 11/1983 Füssner et al. ..... 239/533.9

FOREIGN PATENT DOCUMENTS 2616692 10/1976 Fed. Rep. of Germany ... 239/553.9
8002311 10/1980 Int'l Pat. Institute ..... 239/533.9
2093118 8/1982 United Kingdom ..... 239/533.9

*Primary Examiner*—Andres Kashnikow
*Assistant Examiner*—Michael J. Forman
*Attorney, Agent, or Firm*—Edwin E. Greigg

[57] ABSTRACT

A fuel injection nozzle for internal combustion engines is proposed, which includes a valve needle stressed by a closing spring and a damping device to partially damp the opening movement of the valve needle. The damping is effected in accordance with the stroke frequency, the stroke length of the valve needle, or both, or the quantity of fuel throughput per injection cycle, and the damping effect is preferably variable automatically by shifting the time of the onset of damping relative to the onset of injection. As a result, an adaptation of the damping effect to the operating state of the engine at a particular time can be attained which substantially meets the ideal parameters for such damping.

5 Claims, 2 Drawing Sheets

FUEL INJECTION NOZZLE FOR INTERNAL COMBUSTION ENGINES

BACKGROUND OF THE INVENTION

The invention is based on a fuel injection nozzle for internal combustion engines which has a valve needle stressed by a closing spring and urged in the opening direction by fuel pressure; the valve needle is coupled with a damping device, which during the opening stroke damps the movement of the valve needle in accordance with at least one operating parameter of the engine but is ineffective during the closing stroke. The damping device serves to control the opening cross section of the injection nozzle such that the various demands on the engine at various rpm and loads are met.

Such damping devices are known both for injection nozzles with valve needles opening in the flow direction of the fuel (A-type nozzle) and for those having valve needles opening inwardly (I-type nozzle). In the known injection nozzles, the damping is adapted such that the return action of the damping means, for instance a body having mass, is made complete at every rpm and load point of the engine, and the subsequent opening movement of the valve needle is effected in a damped manner either from the outset or beyond a fixed, predetermined, short pre-stroke. The result of this damping characteristic can be that at higher engine speeds and higher loads, the duration of injection is excessively long.

In order to overcome this disadvantage, it has already been proposed that the damping be made effective even before the end of the opening stroke of the valve needle (German Offenlegungsschrift No. 32 02 364.2). This disclosure provides for a considerable shortening of the total duration of an injection process to be attained.

In spite of these efforts, the problem still exists that the instant when the damping becomes ineffective is fixed in accordance with the needle stroke, and so certain compromises must necessarily be made between idling and full load of the engine.

OBJECT AND SUMMARY OF THE INVENTION

It is a principal object of the apparatus according to the invention to provide the advantage over the prior art that at every operating point of the engine, a damping of the valve needle opening movement and of the injection duration substantially meeting engine requirements is established automatically.

It is another object of the invention to provide that the damping effect can be made variable by means of shifting the onset of damping in time relative to the onset of injection. As a result, the total duration of one injection process at high engine speed and with a large injection quantity can be shortened still further as compared with an apparatus having initial damping of the valve needle, although a long injection duration is retained in effect at low rpm and a low injection quantity. Even during full-load operation of the engine, it has been empirically determined that the duration of one injection process can be made so short that in adapting the injection system to operating conditions, the injection duration can be varied within wider limits than was heretofore possible.

It is a further object of the invention to provide for the possibility of independently influencing the injection duration at high and low rpm.

It is still another object to provide that the number and/or the length of the valve needle stroke or the quantity of fuel throughput per injection process can be ascertained in a simple manner by means of a timing-and-travel member coupled with the valve needle which can be utilized for controlling the damping device. The timing-and-travel member moves out of a first end position into a second end position upon the closing stroke of the valve needle and is subsequently returned toward the first end position at a retarded speed by means of a restoring spring; this member member furthermore activates the damping device anew upon the next opening stroke of the valve needle, once it regains its first end position in the course of its retarded return.

This proposal according to the invention is based upon the recognition that with increasing rpm the interval between two injection procedures becomes shorter, and with larger injection quantities, a longer stroke of the valve needle results. Taking into consideration the fact that the return of the timing-and-travel member begins each time the valve needle begins its closing stroke, the instant of activation of the damping means for the next opening stroke of the valve needle is shifted still further relative to the instant of onset of this opening stroke; thus, the longer the preceding valve needle stroke had been, the shorter the interval between the sequential strokes—that is, the higher the engine rpm. The valve needle is therefore capable of executing an undamped partial stroke at the beginning of an opening stroke, the length of the partial stroke being adapted automatically to the operating parameters of the engine at that time.

It is a still further object of the invention that in the lower rpm and load range, or solely at the critical level which idling represents, the damping remains effective over the entire opening stroke of the valve needle.

It is yet another object of the invention to provide in some cases for a minimum retardation of the damping means, or in other words a minimum free stroke of the valve needle, which exists in all operating points of the engine.

It is yet a further object of the invention to provide a simple and space-saving construction for a nozzles wherein the cylinder and the piston of the damping device simultaneously embody the timing-and-travel member which is activated upon the closing stroke of the valve needle. In that embodiment, the cylinder and the piston have the function of the damping means during the damped partial stroke of the valve needle while during the undamped movements and in the periods when the valve needle is at rest they perform the function of the timing-and-travel member, which sets the retarded initiation of damping in relation to the operating point of the engine.

It is an even further object of the invention to provide an embodiment which is simple and tends not to jam wherein the piston of the damping device is embodied by the end section on the inlet side of the valve needle and a cap placed upon this end section serves as the cylinder.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
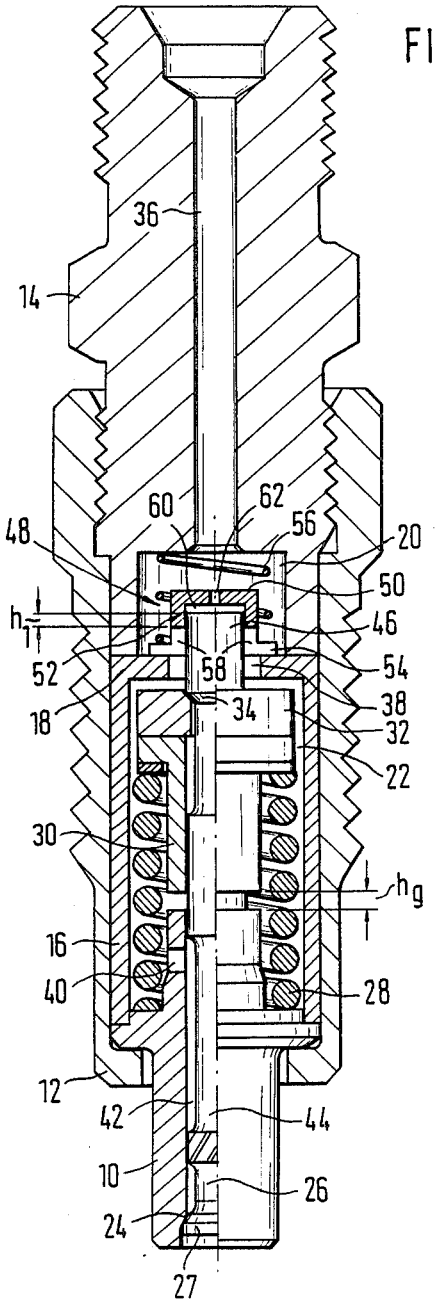
FIG. 1 is a longitudinal section taken through an injection nozzle for a Diesel engine.

The injection nozzle of FIG. 1 has a nozzle body 10, which is clamped firmly to a nozzle holder 14 by a sleeve nut 12. Disposed between the nozzle body 10 and the nozzle holder 14 is a sheath 16, which has an inwardly directed shoulder 18 separating a chamber 20 defined within the nozzle holder 14 from a chamber 22 of larger diameter defined within the sheath 16 in the interior of the injection nozzle. A valve seat 24 is formed in the nozzle body 10, and a valve needle 26 is displaceably supported in the nozzle body provided with a sealing cone 27 pressed by a closing spring 28 against the valve seat 24. The closing spring 28 is supported on the nozzle body 10 and via a flanged part 30 engages a support disk 32, which is supported in turn on a shoulder 34 of the valve needle 26.

An inlet bore 36 is formed in the nozzle holder 14 and discharges into the chamber 20, which communicates via an opening 38 provided in the shoulder 18 with the chamber 22. From this chamber 22, a bore 40 extends through the nozzle body 10 into an annular chamber 42, which is formed between the central bore wall of the nozzle body 10 and the jacket circumference of a section 44 of the valve needle 26 having a reduced diameter; the annular chamber 42 extends toward but not up to the valve seat 24. In the illustrated closed position, a distance $h_g$ is established between the flanged part 30 and the nozzle body 10, which distance represents the total stroke potential of the valve needle 26. The valve needle 26 is displaced by the fuel pressure, counter to the closing spring 28, inwardly to open the valve, until the flanged part 30 strikes the nozzle body 10. When the valve closes, the closing spring 28 returns the valve needle 26 outwardly into the closed position shown.

Adjoining the shoulder 34 of the valve needle 26 is a cylindrically shaped extension 46, which passes through the opening 38 and protrudes into the chamber 20. The diameter of the extension 46 corresponds to the guide diameter disposed medially of the valve needle 26. A cap 48 is placed upon the extension 46, having a jacket portion 52 and a flanged rim 54. The cap 48 is engaged by a restoring spring 46, which surrounds the jacket portion 52 and presses the flanged rim 54 against the shoulder 18 of the sheath 16.

In the flanged rim 54 and a zone adjacent thereto on the jacket portion 52 of the cap 48, oppositely disposed axial slits 58 are provided, through which the fuel is always capable of flowing from the chamber 20 into the chamber 22, even when the valve needle is closed. Between the end face of the extension 46 and a portion 50 of cap 48, a damping chamber 60 is formed in the cap 48, which, throttled via a throttle bore 62 provided in the portion 50, communicates with the flow path of the fuel. In the closed position illustrated, the extension 46 overlaps the slits 58 in the axial direction by the distance $h_1$, which is greater than the total stroke $h_g$ of the valve needle 26. However, the distance $h_1$ could also be less than the total stroke $h_g$ by a minimal amount, so that at the end of the opening stroke of the valve needle 26, a short undamped partial stroke still is produced.

The throttle bore 62 could also be replaced either in part or entirely by a corresponding radial play between the cap 48 and the extension 46. In this embodiment, the cap 48 is centered on the valve needle 25 and provided with a sufficiently large radial play relative to the nozzle holder 14, so that the valve needle 26 can function without jamming. The restoring spring 56 extends partway past the cap 48, so that in this embodiment, the means for partial damping of the opening stroke of the valve needle 26 require only a little space in the axial direction of the injection nozzle.

The extension 46 on the valve needle 26 and the cap 48 simultaneously serve as the means for damping the valve needle movement and as a timing-and-travel member, which makes the onset of damping dependent upon the rpm and the length of the valve needle stroke. The damping effect and the timing-and-travel function are fixed by an appropriate matching of the stiffness of the restoring spring 56 to the size of the throttle bore 62 and other parameters determining the flow of the fuel into and out of the damping chamber 60.

The injection nozzle shown in the drawing functions as follows:

As a result of the increasing fuel pressure at the onset of a first injection procedure, a pressure difference is immediately created between the damping chamber 60 and the chamber 20, because the cap 48 is not capable of following the movement of the valve needle 26. The pressure increase in the damping chamber 60 takes place more slowly than in the chamber 20, so that the movement of the valve needle 26 during this first stroke is retarded or damped from the onset on, or until the valve needle 26 has traveled the distance $h_1$ and the end face of the extension 46 reaches the vicinity of the slits 58. From that point on, a minimal remaining stroke of the valve needle takes place in undamped fashion, until the flanged part 30 strikes the nozzle body 10. The illustrated position of the cap 48 is called its first position in the description which follows.

During the described opening stroke of the valve needle 26, fuel is aspirated or expressed through the throttle bore 62 into the damping chamber 60. During the ensuing closing stroke, the cap 48 is carried upward as well, via the fuel cushion in the damping chamber 60, into a position which will be called the second position. The restoring spring 56 offers only a relatively slight resistance to the substantially stronger closing spring 28 at this time, so that the closing stroke takes place in a substantially undamped fashion. From the onset of the closing stroke on, the restoring spring 56 presses the cap 48 against the end face of the extension 46, whereupon the quantity of fuel which had previously flowed into the damping chamber 60 is now positively displaced out of this chamber 60 once again. This displacement of fuel cushion can take place, in turn, only with a certain retardation, because of the narrow throttle bore. The distance between the first and the second position of the cap 48 corresponds to the valve needle stroke less a short return stroke, which the cap 48 executes during the closing time of the valve needle 26 under the continuous influence of the restoring spring 56.

Figure 2:
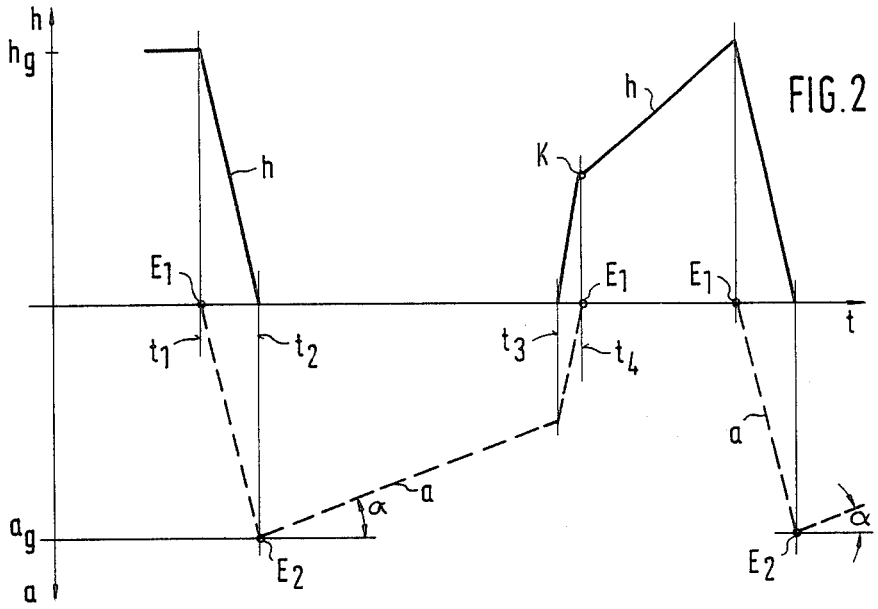
FIGS. 2–4 are diagrams illustrating the functioning of the damping means of the injection nozzle of FIG. 1.

The function of the timing-and-travel member comprising the cap 48, the damping chamber 60 and the restoring spring 56 will now be explained, referring to the diagrams given in FIGS. 2–4. In these diagrams, the course of the valve needle stroke is indicated by solid lines h and the course of the deflection of the cap 48 is indicated by dashed lines a, all plotted over the time t.

In all three diagrams, the closed position of the valve needle 26 and the first position of the cap 48 are disposed on the time axis t.

At time $t_1$ (FIG. 2), the closing stroke of the valve needle 26 is supposed to begin; at this time, the cap 48 is deflected out of the first position $E_1$ into the second position $E_2$. The cap 48 thereby traverses a distance $a_g$, which as already mentioned is somewhat shorter than the total stroke $h_g$ of the valve needle 26. The closing stroke is ended at time $t_2$. From then on, the cap 48 begins to move back toward shoulder 18 at a predetermined speed, under the influence of the restoring spring 56; this speed is represented in the diagram as the angle $\alpha$.

At time $t_3$, a new opening stroke of the valve needle 26 begins. If, as shown in FIG. 2, the cap has not yet reattained its first position by the time $t_3$, then it is returned into this first position with approximately the same speed as the opening of valve needle 26. The cap 48 then regains its first position at the time $t_4$. From then on, the cap 48 is firmly restrained by the shoulder 18 from making any further movement in the opening direction of the valve needle 26; as a result, the described damping means again come into effect. This can be seen in the diagram in that the speed of the stroke at time $t_4$ changes abruptly at K. From time $t_4$, the valve needle 26 is moved at a damped or reduced speed into the terminal stroke position, whereupon the above course of events is repeated.

Figure 3:
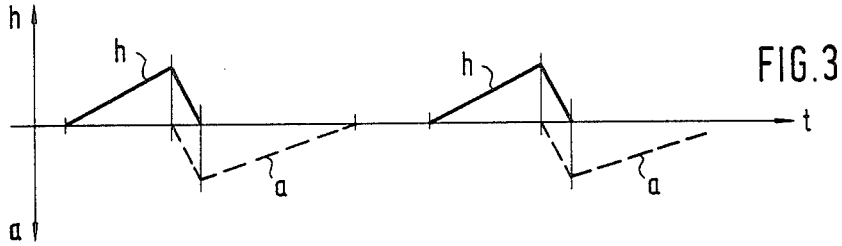
Figure 4:
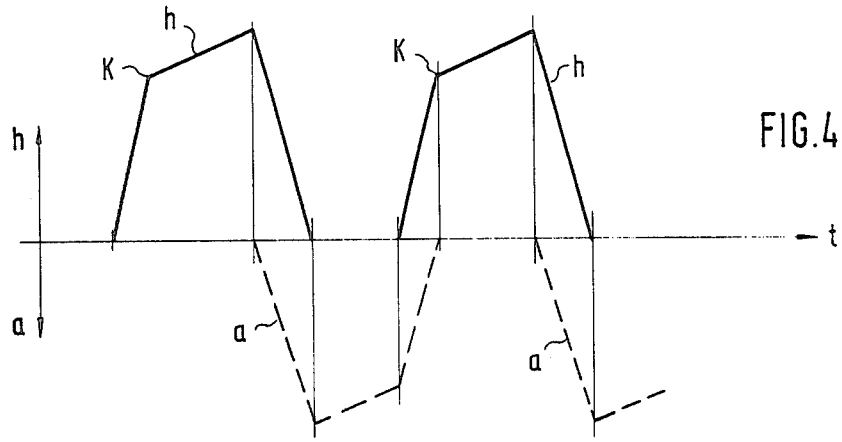

FIGS. 3 and 4 show that the damping device according to the invention automatically adapts to the various operating states of the engine. In FIG. 3, the engine is operating at low rpm and low load, and the cap 48 already attains its first position before the next opening stroke begins. In this case, the damping is effective over the entire opening stroke of the valve needle 26. In FIG. 4, an operating state is shown in which the engine is operating at high rpm under a heavy load, and so a long valve needle stroke is established as well. In that case, the next opening stroke begins before the cap 48 has returned to its first position. The speed-changing point K of the stroke course h of the valve needle 26 is shifted still farther toward the end of the stroke than in the operating state shown in FIG. 2, so that a shorter portion of the opening movement of the valve needle 26 is damped. FIG. 4 also shows clearly that the speed-changing point K is shifted farther toward the end of the opening stroke of the valve needle, the more rapid the sequence of injection procedures and the longer the valve needle stroke.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel injection nozzle for internal combustion engines having a valve needle arranged to execute a stroke, said stroke having a length and frequency, said valve needle being urged to close by a spring means, said valve needle further being urged to open by fuel pressure and being provided with means effective to damp movement thereof only when said valve needle opens, said means being operative in accordance with at least one operating parameter of the engine, characterized in that said means comprises a timing-and-travel member responsive to at least one of the length of said stroke, the frequency of said stroke, and a fuel quantity discharged per injection cycle, said timing and travel member providing variable damping of said valve needle, the variation being provided by varying onset of damping relative to onset of injection, and further that said timing-and-travel member is coupled with the valve needle, said timing-and-travel member being arranged to move from a first position into a second position during the closing stroke of the valve needle, said timing-and-travel member being provided with a restoring spring to return said member to said first position at a retarded speed after said valve needle has closed, whereby upon an opening stroke of the valve needle said means effective to damp movement is activated to execute a retarded return movement into said first position.

2. An injection nozzle as defined by claim 1, characterized in that the retarded return movement of the timing-and-travel member is brought about by hydraulic means.

3. An injection nozzle as defined by claim 2, further characterized in that said hydraulic means comprises a fuel-filled damping chamber disposed within a cylinder, said chamber being provided with a throttle opening to receive fuel flow, said cylinder being provided with a piston arranged to execute a relative movement with respect to the cylinder, said movement acting to vary a volume of the damping chamber so as to provide a selective damping of said valve needle during an opening stroke thereof.

4. An injection nozzle as defined by claim 3, further characterized in that said timing-and-travel member comprises the cylinder and the piston of the damping device and said member is activated upon a closing stroke of the valve needle.

5. An injection nozzle as defined by claim 4, further characterized in that the piston of the damping device comprises an upstream extension of the valve needle and the cylinder is defined by a cap associated with said piston.

* * * * *